United States Patent [19]

Abe et al.

[11] 4,238,172

[45] Dec. 9, 1980

[54] HERMETIC MOTOR-COMPRESSOR

[75] Inventors: Nobuo Abe; Susumu Yamazaki; Isao Kanamori, all of Tochigi, Japan

[73] Assignee: Hitachi, Ltd., Japan

[21] Appl. No.: 897,399

[22] Filed: Apr. 18, 1978

[30] Foreign Application Priority Data

Apr. 20, 1977 [JP] Japan ..... 52-44478

[51] Int. Cl.[3] ..... F04B 39/12

[52] U.S. Cl. ..... 417/312; 417/363; 417/902

[58] Field of Search ..... 417/312, 313, 902, 363

[56] References Cited

U.S. PATENT DOCUMENTS

| | | | |
|---|---|---|---|
| 2,929,552 | 3/1960 | McGregor | 417/363 |
| 3,075,686 | 1/1963 | Steinhager | 417/363 |
| 3,209,991 | 10/1965 | Sauber | 417/902 X |
| 3,411,705 | 11/1968 | Grover | 417/902 X |
| 3,454,213 | 7/1969 | Valbjorn | 417/363 |
| 3,458,121 | 7/1969 | Gleason et al. | 417/312 X |
| 3,480,206 | 11/1969 | Evemark et al. | 417/312 X |
| 3,698,840 | 10/1972 | Hover | 417/902 X |
| 4,033,707 | 7/1977 | Stutzman | 417/902 X |

*Primary Examiner*—Carlton R. Croyle
*Assistant Examiner*—Edward Look
*Attorney, Agent, or Firm*—Craig and Antonelli

[57] ABSTRACT

A hermetic motor-compressor having a compression mechanism section and a driving motor section resiliently supported in a closed container. The compression mechanism part has a cylinder to the top of which are attached a valve seat cover assembly together with a valve seat member, valves and so forth interposed therebetween. The valve seat cover assembly has a base plate which projects laterally beyond the diameter of the cylinder, so as to present wing areas. A cover member which defines gas passages is attached to one side of the base plate, while suction and delivery-side silencer chambers are attached to the other side of the base plate at the wing areas of the latter. Consequently, the silencer chambers are confined within small areas between the cylinder and the base plate of the valve seat cover assembly, so as to reduce the overall size of the compressor.

2 Claims, 7 Drawing Figures

HERMETIC MOTOR-COMPRESSOR

BACKGROUND OF THE INVENTION

The present invention relates to a hermetic motor-compressor having a compression mechanism section and a driving electric motor section on and under a resiliently-supported frame confined in a closed container and, more particularly, to a hermetic motor-compressor having an improved construction of a valve seat cover assembly mounted on the top of the cylinder of the compressor.

Conventional hermetic motor-compressors of the kind described have had various drawbacks or shortcomings which are derived mainly from a too large number of parts such as connection pipes, supporting plates and the like, as well as the complicated process for manufacturing the valve seat cover including silencer chambers.

SUMMARY OF THE INVENTION

It is therefore an object of the invention to provide a hermetic motor-compressor having a reduced number of parts and incorporating a valve seat cover assembly including silencer chambers, which can be manufactured through a simple and continuous manufacturing process.

To this end, according to the invention, there is provided a hermetic motor-compressor of a type having a compressor body resiliently supported in a closed container, the compressor body including a cylinder and a valve seat cover means secured to the top portion of the cylinder, together with a valve seat member, valves and other associated members interposed therebetween, characterized in that the valve seat cover means are a composite body or an assembly of plastically worked steel webs or plates including a base plate, at least the base plate being elongated in the breadthwise direction to provide wing areas, and that a cover defining gas passages and delivery valves is attached to one side of the base plate, while silencer chambers are attached to the other side of said base plate at the wing areas of the latter.

The above and other objects, as well as advantageous features of the invention will become clear from the following description of preferred embodiment taken in conjunction with the accompanying drawings.

DESCRIPTION OF THE PREFERRED EMBODIMENTS

Before turning to the description of the preferred embodiments of the invention, an explanation will be made here as to the conventional hermetic motor-compressor, with specific reference to FIGS. 1 and 2.

Figure 1:
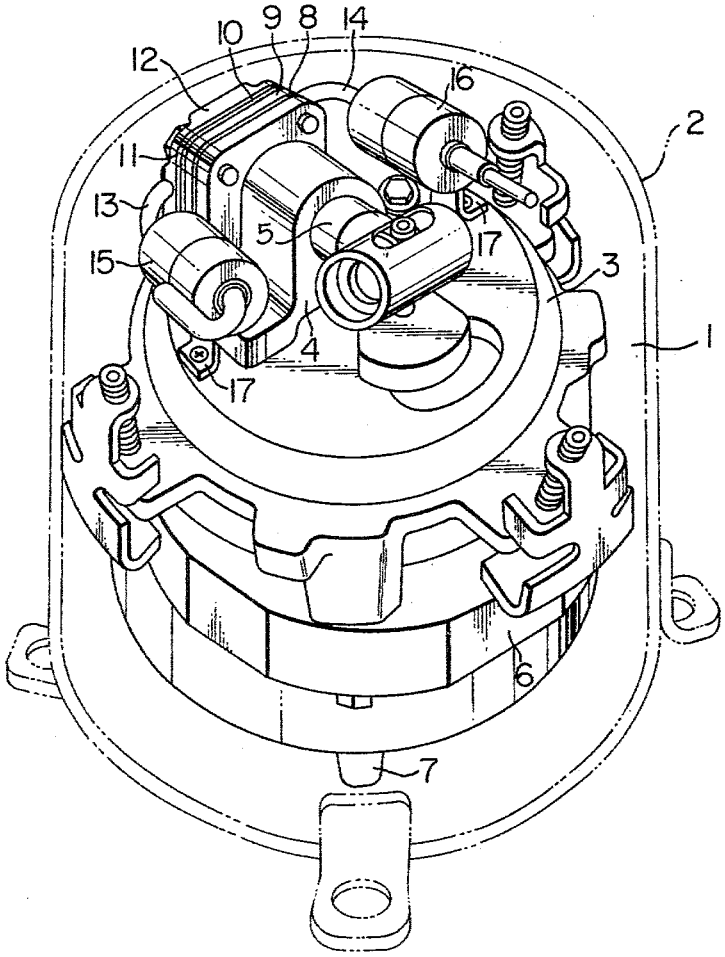
FIG. 1 PRIOR ART
FIG. 1 is a perspective view of a conventional hermetic motor-compressor.

Referring first to FIG. 1, a typical conventional hermetic motor-compressor generally designated at 1 has a closed container 2, a frame 3 resiliently supported and disposed in the container 2, a compression mechanism section mounted on the frame 3 and including a cylinder 4, piston 5 and so forth, and a driving electric motor section 6 attached to the lower side of the frame 3.

The compression mechanism section and the driving electric motor section 6 are connected to each other through a rotary shaft 7. Reference numerals 8, 9, 10 and 11 denote, respectively, a suction valve, a suction valve seat, a delivery valve and a joint seat, respectively.

A valve seat cover 12 is adapted to be fastened to the top of the cylinder 4, through the suction valve 8, valve seat 9, delivery valve 10 and the joint seat 11, by means of tie rod screws or the like.

A suction-side silencer chamber 15 and a delivery-side silencer chamber 16 are adapted to be fixed to the frame 3, through respective supporting plates 17.

Figure 2:
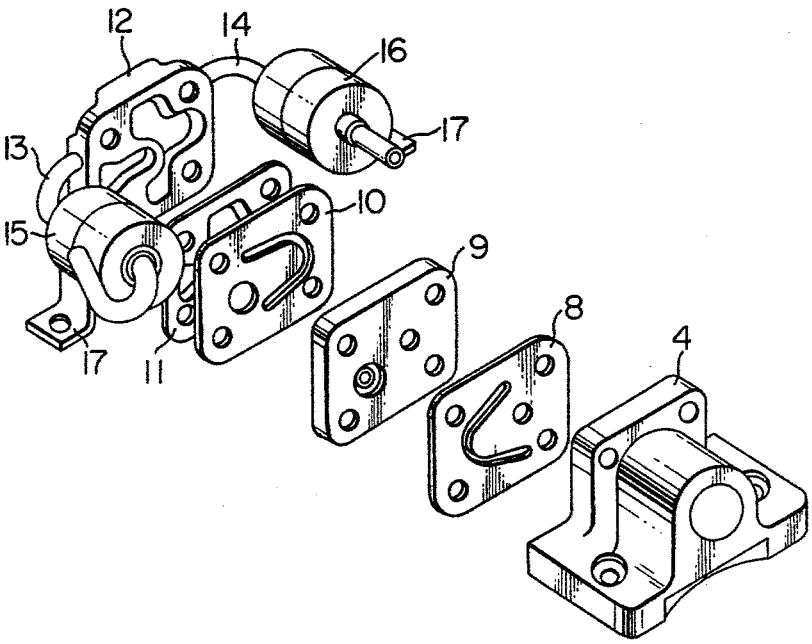
FIG. 2 PRIOR ART
FIG. 2 is an exploded perspective view of parts such as a cylinder, valve seat cover and so on, incorporated in the motor-compressor as shown in FIG. 1.

Referring now to FIG. 2 showing the detail of the parts such as the valve seat cover 12, valve seat 9, cylinder 4 and so on the valve seat cover 12 is connected to the suction and the delivery side silencer chambers 15 and 16, through pipes 13 and 14, respectively. The supporting plates 17 for fixing these chambers of the frame 3 are appended to the associated chambers.

The conventional hermetic motor-compressor having the described construction has suffered the following disadvantages.

(1) The valve cover 12 is manufactured by an inefficient process mainly consisting of metal-removing step such as milling or cutting, from a material of cast iron or the like, so as to have a small size and shape conforming to the shape of the juncture surface and the outer profile of the valve seat 9.

(2) The gas suction passage and the delivery valve chamber of the valve seat cover 12 are connected to the suction-side silencer chamber 15 and the delivery-side siliencer chamber 16, through connection pipes 13 and 14, respectively. The connection pipes 13 and 14 are extended between the openings formed in the sides of the valve seat cover 12 and respective silencer chambers, and have to be bent, as shown in FIGS. 1 and 2, for minimizing the size of the assembly to make the latter accommodated by the small-sized closed container 2. This causes a substantial problem in connection with the precision of manufacturing and installation of the valve seat cover, in relation with the siliencer chambers.

(3) As stated in the preceding item (1), the valve seat cover made of cast iron is finished by a mechanical processing. On the other hand, the silencing section including the connection pipes 13, 14 are constituted by a composite body of plastically worked steel plates which are connected to one another by a silver-soldering effected in a hearth. Thus, the valve seat cover and the silencing section are fabricated separately, through different processes. Consequently, it is necessary to connect the connection pipes 13, 14 to the valve seat cover 12 by solders such as of silver, in the course of assembling the compressor. The combination of these different kinds of work is quite inconvenient from the view points of production efficiency and saving of resources or materials.

(4) The silencer chamber section is often vibrated resonantly by the vibration generated during running of the compressor, so that the breakage of the connection pipes or other accident is likely to be caused by the amplified vibration. In order to prevent the resonant vibration through increasing the rigidity, the supporting plates 17 are annexed to respective chambers and fastened to the frame by mean of, for example, screws, thereby to secure the silencer chambers 15, 16 to the frame. Therefore, the assembling process has to include a troublesome step of fixing the silencer chambers by tightening the screws, resulting in a deteriorated efficiency of automatic assembling. In addition, this stiffening arrangement requires an uneconomically inceased number of parts.

It is remarkable that the foregoing disadvantages of the prior art are fairly overcome by the invention which provides a hermetic motor-compressor consisting of a reduced number of parts and having a valve seat cover assembly including the silencer chambers which can be manufactured easily by a continuous manufacturing process, as will be realized from the following description of the preferred embodiment taken in conjunction with FIGS. 3 through 6 inclusive.

Figure 3:
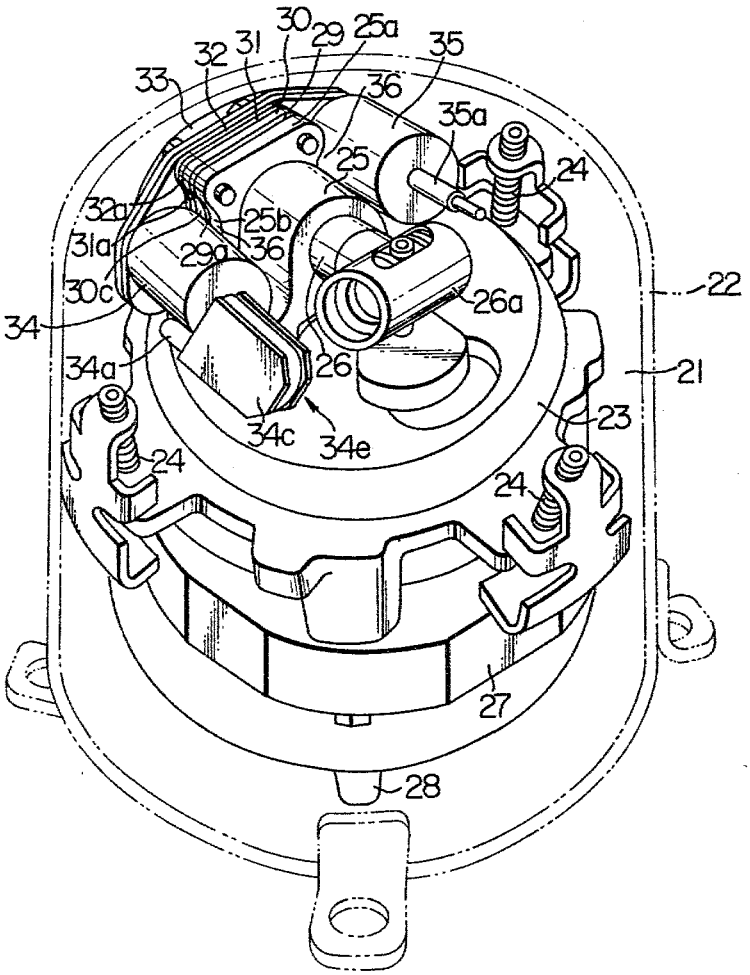
FIG. 3 is a perspective view of a motor-compressor in accordance with the invention.

Referring first to FIG. 3, a hermetic motor-compressor embodying the invention, generally denoted by a numeral 21, has a closed container 22, in which resiliently supported is a frame 23 by means of, for example, suspension springs 24. The compression mechanism section including a cylinder 25, piston 26 and so forth is mounted on the frame 23, while a driving electric motor section 27 is attached to the back side of the frame 23.

The compression mechanism section and the driving electric motor section 27 are operably connected to each other through a rotary shaft 28.

A valve seat assembly 33 is fastened to the head 25*a* of the cylinder 25, by means of screws or tie bolts, with a suction valve 29, valve seat 30, delivery valve 31 and a joint seat 32 interposed therebetween.

Figure 4A:
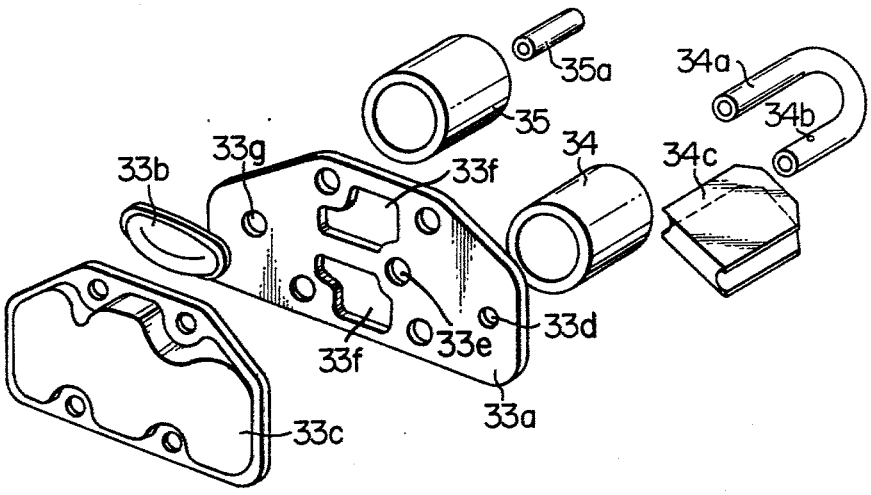
FIG. 4*a* is an exploded perspective view of a valve seat cover assembly of the motor-compressor in accordance with the invention, showing the parts constituting the valve seat assembly.
Figure 4B:
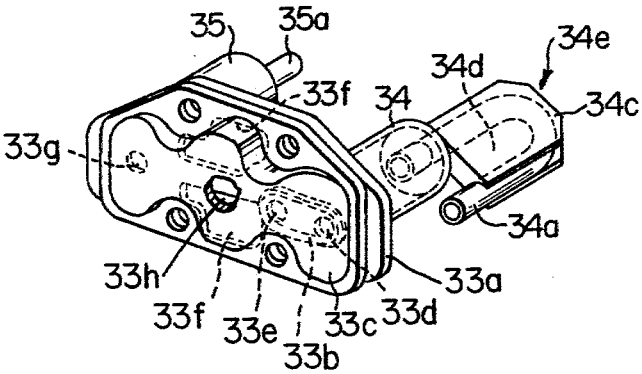
FIG. 4*b* is a perspective view of the valve seat cover assembly as shown in FIG. 4*a* in the assembled condition.

As will be most clearly seen from FIGS. 4*a* and 4*b*, the valve seat cover assembly 33 has a base plate 33*a* as one of its major parts. The base plate 33*a* has such a breadth to project laterally beyond the sides of the head 25*a* of the cylinder 25. A delivery passage member 33*b* and a cover 33*c* are adapted to be attached to one side of the base plate 33*a*, while a suction-side silencer chamber 34 and a delivery-side silencer chamber 35 are directly attached to the other side of the base plate 33*a* at their joint surfaces. The delivery passage member 33*b* is disposed at the inside of the cover 33*c*, so as to form a passage which allows a mutual communication of a communication bore 33*d* and a delivery bore 33*e* formed in the base plate 33*a*. The communication bore 33*d* provides a communication of the delivery side space with the delivery side silencer chamber 35, while the delivery bore 33*e* leads to a delivery port 30*b* formed in the valve seat 30. The cover 33*c* contains at least the delivery passage member 33*b* and suction bores 33*f* formed in the base member 33*a*, and is so constructed as to make a suction port 30*a* formed in the valve seat 30 communicate with a communication bore 33*g*. The communication bore 33*g* is formed in the base plate 33*a*, and is adapted to be connected to the suction-side silencer chamber 34.

As the base plate 33*a* and the cover 33*c* are brought together, the base plate 33*a*, inner face of the cover 33*c*, outer face of the delivery passage member 33*b* and the suction bore 33*f* in combination define a delivery valve chamber 33*h* whose volume is equal to the stroke volume of the compressor or larger.

The suction and delivery-side silencer chambers 34 and 35 are directly attached to the base plate 33*a* at both wing portions of the latter in such a manner that the associated communication bores 33*d*, 33*g* formed in the base plate are included in the area within the diameters of respective silencer chambers. A suction pipe 34*a* and a delivery pipe 35*a*, as well as other associated members are attached to the opposite ends of respective silencer chambers to the base plate 33*a*.

It is to be noted here that the suction pipe 34*a* is bent to have a U-shaped profile, and is provided with a bore 34*b* of a suitable diameter at the inner side of the U-shaped form. Reference numeral 34*c* denotes a member constituted by a steel plate bent to have a square-bracket-shaped cross-section. This steel plate member 34*c* has two opposing portions that are separated from each other by a distance substantially equal to the outer diameter of the suction pipe 34*a*, and has a breadth substantially equal to the outer breadth of the U-bent suction pipe 34*a*. The steel plate member 34*c* is adapted to be combined with the suction pipe 34*a* in the manner as shown in FIG. 4*b*.

All of the foregoing members such as the base plate 33*a*, delivery passage member 33*b*, cover 33*c*, suction-side silencer chamber 34, delivery-side silencer chamber 35 and the square-bracket-shaped steel plate member 34*c* are formed by plastic working of relatively thin steel web blanks.

In assembling, the steel plate member 34*c* is temporarily fixed together with the suction and the delivery pipes 34*a*, 35*a*. Then, a soldering is effected in a hearth to solder the joint areas of these members in a sealing manner. Since the suction pipe 34*a* is soldered to the square-bracket-shaped steel plate member 34*c* in a sealing manner over the entire length of the line of contact, these two members in combination form a resonance opening and a resonance chamber 34*d*, thereby to constitute a silencer 34*e* of resonance type.

Figure 5:
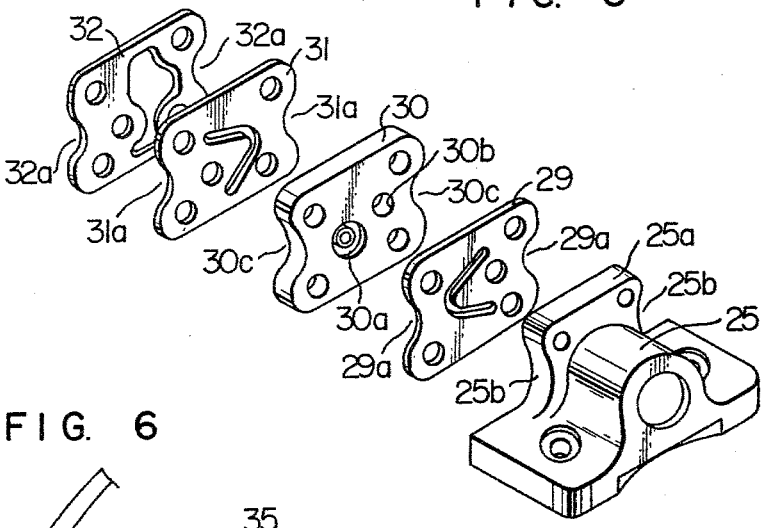
FIG. 5 is a perspective view of the major parts of the motor-compressor of the invention, such as a cylinder, valve seats and so forth.

FIG. 5 clearly illustrates the configurations of members associated with the valve seat cover assembly 33 including the silencer chambers, such as the cylinder 25, suction valve 29, valve seat 30, delivery valve 31, and the joint seat 32. It will be seen that these members are all recessed at their both sides, as at 29*a*, 30*c*, 31*a*, 32*a* and 25*b*. Thanks to the provision of these recesses, the inner sides of the suction and delivery-side silencers 34, 35 can clear these recessed members, by a suitable clearance 36, when the valve seat cover assembly 33 is mounted in the manner as shown in FIG. 3.

The valve seat cover assembly 33, suction valve 29, valve seat 30, delivery valve 31 and the joint seat 32 as shown in FIGS. 4 and 5 preferably have a height equal to or smaller than the height of the head 25*a* of the cylinder 25 bound to be connected to these members, so that the lower sides of these members may fairly clear the top face of the frame 23 on which the cylinder 25 is mounted.

Similarly, in order that a slide cam 26*a*, which is formed unitarily with a piston 26 constituting the compression mechanism section, may not be contacted by the end surfaces of the suction and delivery-side silencer chambers 34, 35, the axial lengths of the silencer chambers are so selected as to be smaller than the minimum distance between the base plate 33*a* and the slide can 26 when the latter is at the top dead center in its stroke.

Figure 6:
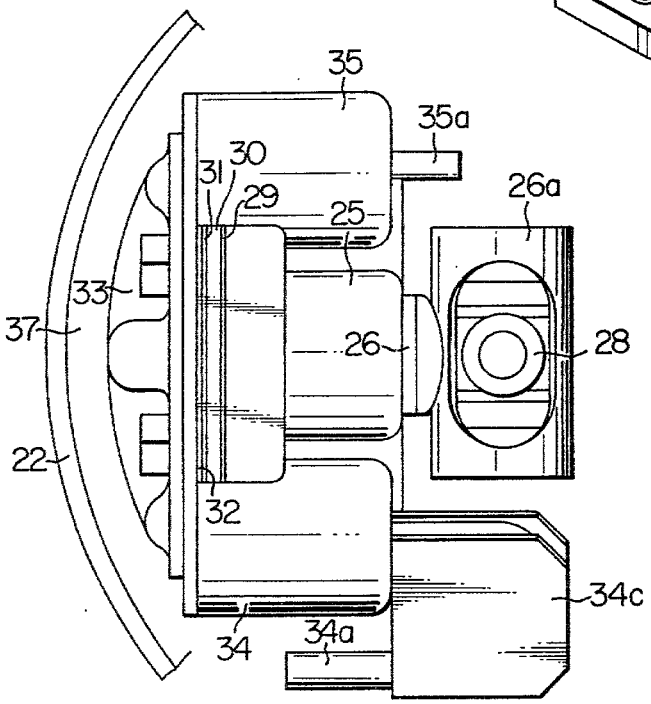
FIG. 6 is a plan view of the closed container and the valve seat cover assembly of the motor-compressor of the invention, showing how these parts are related to each other.

In order to preserve a gap 37 of a desired width between the inner surface of the closed container 22 and the outer surface of the valve seat cover assembly 33, in the assembled state in which the compression mechanism section carrying the valve seat cover assembly 33 and the driving electric motor section 27 are correctly attached to the frame 23 resiliently supported in the closed container 22, the valve seat cover assembly 33 is made to have an outer configuration well conforming the inner profile of the closed container 22, as will be seen from FIG. 6. Thanks to the provision of the gap 37, no collision of the compressor assembly with the wall of the closed container 22 is incurred even when the compressor is vibrated slightly at the time of starting and stopping.

The hermetic motor-compressor having the valve seat cover assembly 33, cylinder 25 and other parts as described has various advantageous features as summarized below.

(1) Most of the members constituting the valve seat cover assembly and silencer chambers are plastically-worked thin steel webs. That is, most of the parts can be processed by the same kind of plastic working, so as to afford an advantage of efficient automatic material supply and assembling, especially in case of mass production.

(2) The number of parts is minimized, while the shapes of the parts are selected to economize the material to be used. At the same time, since the silencing chambers and associated members are disposed in the vicinity of the cylinder 25 which is a major constituent of the compressor, the valve seat cover assembly can be held in quite a stable and compact manner. Consequently, the size of the hermetic motor-compressor is reduced considerably.

(3) The lateral breadth of the base plate 33*a* constituting the valve seat cover assembly 33 is increased to preserve the space for attaching the silencing chambers, allowing the height of the members such as the valve seat cover assembly 33 and the valve seat 30 to be reduced. Consequently, the lower edges of the members such as the valve seat cover assembly 33, valve seat 30 and so on adapted to be jointed to the cylinder 25 can fairly clear the top surface of the frame 23 on which the cylinder 25 is mounted. Thanks to this feature, it becomes possible to design various capacities of compressors by adopting different stroke lengths, without substantially changing other principal dimensions. In addition, since the valve seat cover assembly and other members are constituted by plastically worked thin steel webs or plates, the small space defined by the base plate 33*a* and the slide cam 26*a* can economically used as the space for the silencer chambers, contributing greatly to minimize the size of the compressors, as effectively as the feature stated in the foregoing item 2.

(4) Most of the user's claims on the hermetic compressors are focussed on the high level of noise attributable to the direct contact of the compressor body with the wall of the closed container 22, due to the resilient supporting of the compressor body in the container. According to the invention, however, the undesirable direct contact of the compressor body with the container is fairly avoided thanks to the provision of the gap between the outer face of the valve seat assembly and the wall of the closed container, afforded by the outer configuration of the valve seat cover assembly well conforming to the inner profile of the closed container. Thus, the compressor body in the invention is entirely free from the unfavourable noises, presenting an improved reliability of the hermetic motor-compressor.

(5) As stated before, the major parts such as valve seat cover assembly 33 are constituted by thin steel webs. Consequently, the total volume of the valve chamber 33*h* can be increased as compared with that of the conventional compressors incorporating a iron-cast valve seat cover, resulting in a corresponding reduced resistance to the flow of gas and a consequent increased compression efficiency.

In addition, for the most part the noise generated at the suction side can be extinguished, by suitably selecting the position of the resonance bore and the volume of the resonance chamber of the resonance silencer 34*e*, which is formed making the most of the curved configuration of the suction pipe 34*a*, such that the resonance frequency of the resonance chamber match the frequency of the noise.

Having described the invention through its preferred form, it is to be noted here that various changes and modifications are possible, without departing from the spirit and scope of the invention which are limited solely by the appended claims.

What is claimed is:

1. A hermetic motor-compressor comprising a closed container with motor means and compressor means disposed within said container and drivingly connected to one another, said compressor means including:

a piston and cylinder assembly, the cylinder of said piston and cylinder assembly having a cylinder head;

a valve assembly attached to said cylinder head and including a valve member and a valve seat member, having therein a suction port and a delivery port;

a valve seat cover assembly attached to said valve assembly with the latter interposed between said valve seat cover assembly and said cylinder head, said valve seat cover assembly including a base plate having one end face thereof in contact with said valve assembly and a cover member attached to the other end of said base plate, delivery passage means and suction valve chamber means being defined between said base plate and said cover member, said base plate having side extensions which respectively project outwardly from opposed sides of said base plate beyond the sides of said cylinder head; and suction-side and delivery-side silencer chambers respectively attached directly to said side extensions of said base plate with said valve assembly and said cylinder interposed between said suction-side and delivery-side silencer chambers, said delivery-side silencer chamber being in communication with said delivery passage means and said suction-side silencer chamber being in communication with said suction valve chamber means, and wherein said compressor means further includes a member disposed between said base plate and said cover member for defining said delivery passage means, said delivery passage defining member as well as said base plate and said cover member being formed of a plastically worked relatively thin steel sheet material, wherein said base plate has therein a pair of apertures respectively communicating with the ends of said delivery passage means and a further aperture communicating with said suction valve chamber means, said suction-side silencer chamber being in communication with said suction port in said valve seat member through said further aperture and said suction valve chamber means, said delivery-side silencer chamber being in communication with said delivery port in said valve seat member through said pair of apertures and said delivery passage means, and wherein said suction valve chamber means has a volume at least equal to the displaced volume within said cylinder.

2. A hermetic motor-compressor comprising a closed container with motor means and compressor means disposed within said container and drivingly connected to one another, said compressor means including:

a piston and cylinder assembly, the cylinder of said piston and cylinder assembly having a cylinder head;

a valve assembly attached to said cylinder head and including a valve member and a valve seat member, having therein a suction port and a delivery port;

a valve seat cover assembly attached to said valve assembly with the latter interposed between said valve seat cover assembly and said cylinder head, said valve seat cover assembly including a base plate having one end face thereof in contact with said valve assembly and a cover member attached to the other end of said base plate, delivery passage means and suction valve chamber means being defined between said base plate and said cover member, said base plate having side extensions which respectively project outwardly from opposed sides of said base plate beyond the sides of said cylinder head; and suction-side and delivery-side silencer chambers respectively attached directly to said side extensions of said base plate with said valve assembly and said cylinder interposed between said suction-side and delivery-side silencer chambers, said delivery-side silencer chamber being in communication with said delivery passage means and said suction-side silencer chamber being in communication with said suction valve chamber means, and wherein said compressor means further includes a resonance silencer, said resonance silencer including a U-shaped suction pipe having two leg sections and a connecting section therebetween, one of said two leg sections being connected to the end of said suction-side silencer chamber opposite to said valve seat cover assembly, said U-shaped suction pipe having in its wall a resonance bore, two steel panels spaced from one another a distance substantially equal to the outer diameter of said U-shaped suction pipe, said two steel panels being secured to said U-shaped suction pipe and cooperating therewith to define an open ended space between said two leg sections of said U-shaped suction pipe with said resonance aperture in the wall of said U-shaped suction pipe being in communication with said open ended space, and an end steel panel extending between said two spaced steel panels to close said open ended space.

* * * * *

UNITED STATES PATENT AND TRADEMARK OFFICE

CERTIFICATE OF CORRECTION

PATENT NO. : 4,238,172 Page 1 of 2

DATED : December 9, 1980

INVENTOR(S) : Nobuo Abe et al.

It is certified that error appears in the above—identified patent and that said Letters Patent is hereby corrected as shown below:

Fig. 4a and 4b should appear as shown.

FIG. 4a

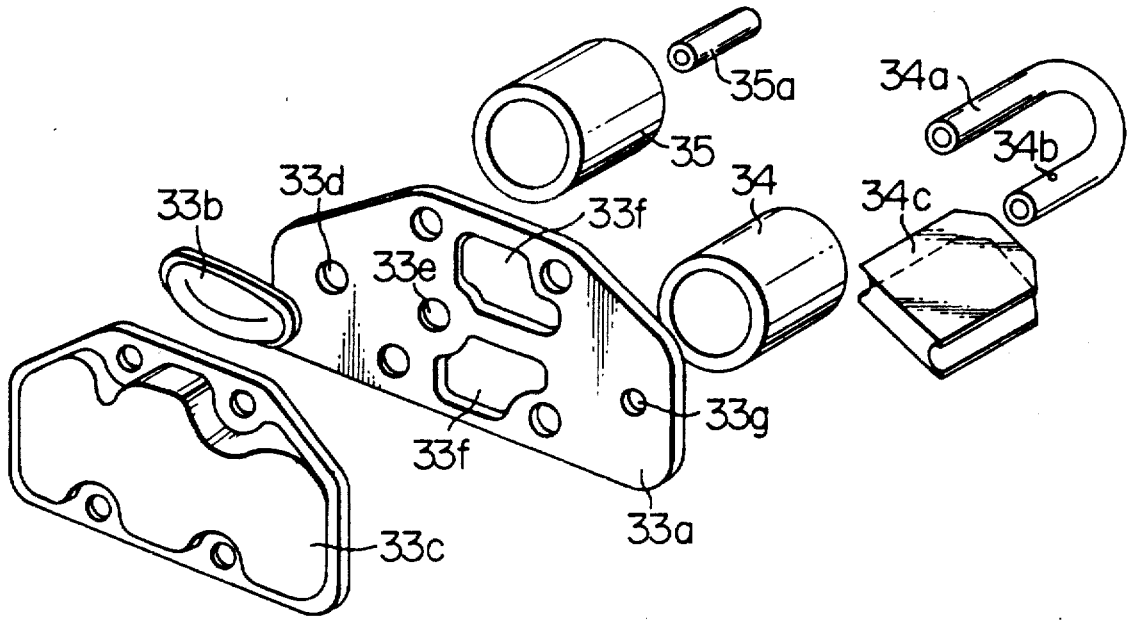

UNITED STATES PATENT AND TRADEMARK OFFICE

CERTIFICATE OF CORRECTION

PATENT NO. : 4,238,172

DATED : December 9, 1980

INVENTOR(S) : Nobuo Abe et al.

It is certified that error appears in the above—identified patent and that said Letters Patent is hereby corrected as shown below:

FIG. 4b

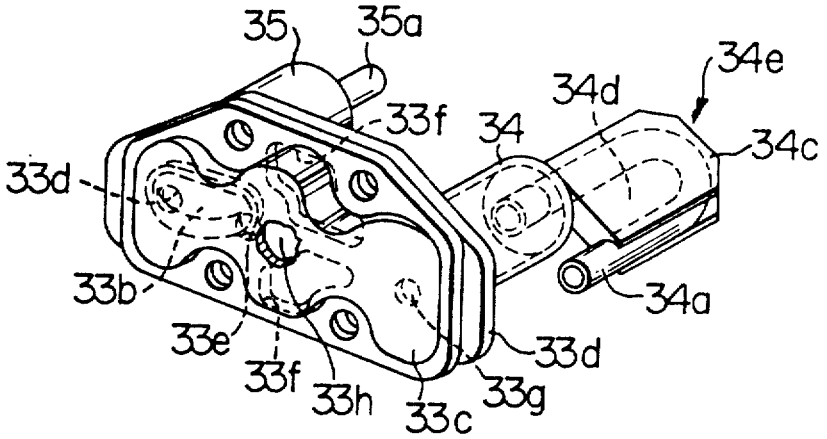

Signed and Sealed this

Fourteenth Day of July 1981

[SEAL]

Attest:

GERALD J. MOSSINGHOFF

Attesting Officer

Commissioner of Patents and Trademarks